US005701715A

United States Patent [19]

Masters et al.

[11] Patent Number: 5,701,715

[45] Date of Patent: Dec. 30, 1997

[54] TIE CONNECTOR FOR MODULAR BUILDINGS

[75] Inventors: William Cecil Masters, Lakeland, Fla.; William J. Kalker, Jr., Monroe, Conn.

[73] Assignee: Building Technologies, Inc., Bartow, Fla.

[21] Appl. No.: 561,093

[22] Filed: Nov. 21, 1995

Related U.S. Application Data

[63] Continuation of Ser. No. 249,622, May 26, 1994, abandoned.

[51] Int. Cl.[6] ..... E04B 1/38

[52] U.S. Cl. ..... 52/698; 52/DIG. 11; 52/23; 248/503

[58] Field of Search ..... 52/169.12, DIG. 11, 52/4, 5, 23, 148, 149, 688, 712, 714; 248/500, 503

[56] References Cited

U.S. PATENT DOCUMENTS

| | | | |
|---|---|---|---|
| 1,714,681 | 5/1929 | Loucks | 52/714 |
| 2,453,835 | 11/1948 | Donkin | 248/503 X |
| 3,125,177 | 3/1964 | Paller | 248/503 X |
| 3,210,898 | 10/1965 | Kurtz | 52/714 X |
| 3,730,466 | 5/1973 | Swanquist | 52/714 X |
| 3,830,457 | 8/1974 | Stewart | 52/DIG. 11 |
| 3,894,365 | 7/1975 | Abbott | 52/23 |
| 3,972,170 | 8/1976 | Brammer | 52/DIG. 11 X |
| 4,920,713 | 5/1990 | Borresen et al. | 52/712 X |
| 5,014,470 | 5/1991 | Cane et al. | 52/DIG. 11 X |

*Primary Examiner*—Carl D. Friedman
*Assistant Examiner*—Creighton Smith
*Attorney, Agent, or Firm*—Maguire, Voorhis & Wells; Robert L. Wolter, Esq.

[57] ABSTRACT

A tie connector for joining a modular type building or the like to the ground. One version of the tie connector having a substantially L-shaped body with an elongated slot through one side. The elongated slot provides an attachment site for a hurricane type strap to be inserted and coupled to a buckle. The opposite end of the tie connectors are attached to horizontal support members around the perimeter of the modular building. The hurricane straps are then inserted through the elongated slots and secured to a ground anchor. Another version of the tie connector provides a Substantially L-shaped body with an additional vertical flap that can be affixed to vertical support members giving additional stability. The elongated slot has the unique feature of rounded edges of sufficient radius thereby omitting any type of cutting effect that might occur when the straps are under high stress conditions.

7 Claims, 6 Drawing Sheets

TIE CONNECTOR FOR MODULAR BUILDINGS

This application is a continuation of application Ser. No. 08/249,622 filed May 26, 1994, now abandoned.

BACKGROUND OF INVENTION

This invention relates to an apparatus for connection a modular building to a ground anchor via a tie connector thereby directly transferring the load to the earth. The primary use of these connectors are to serve as a means by which a conventional hurricane anchoring system may be attached to elements that will be under the high vertical load conditions. Connecting a modular type building or the like to a secured ground anchor is essential when the modular building is subjected to strong winds such as hurricanes, tornadoes and other violent storms.

More specifically, this invention provides a tie connector, generally L-shaped, that is preinstalled during the construction of modular type buildings. Additionally, the L-shaped tie connector provides an elongated slot protruding from beneath the modular building wherein an anchor strap can be easily connected. The opposite end of the tie connector is secured to a horizontal support member of the modular building via a horizontal flap and bolting means. Another version of the tie connector is to have an additional vertical flap, adjacent the horizontal flap, to be secured or bolted to a vertical support member of the modular building thereby giving additional support.

In the past the primary method of resisting the vertical force component was through the use of hurricane anchors at each of the hurricane strap running up one wall, over the roof and down the other side of the home. This method created a problem because many times the roof rafters used were not capable of withstanding the forces applied to them. A second method was to use a manufactured section of hurricane strap material with holes punched at one end. As a result of the high number of holes placed in the hurricane strap material, the capacity of the connections was greatly reduced. To work around this, the industry placed theses straps at a closer spacing taking into consideration the reduced capacity.

Under new Federal regulations, vertical ties must be capable of withstanding 3150 pounds must be placed at each diagonal tie location. This mandate created a problem that the manufactured housing industry never had to deal with, consequently producing a need for the vertical tie connectors that will still permit the use of the hurricane ground anchors on the market today.

It has been customary to secure mobile homes and other types of modular buildings to the ground using special straps and ground anchors. Several approaches have been provided for, in Dannemiller of U.S. Pat. No. 4,570,403 a "Means for anchoring a prefabricated, modular building to a foundation wall takes the form of an integral sheet metal strap formed with a base flange and intermediate body section for embeddment in the foundation wall and an exposed upper, plate-like building attachment section extending outwardly from the intermediate body section above the foundation wall and formed with a weakened, bendable intermediate portion and an outer perforated plate portion for fastening to the base of the building." While this invention has its advantages, it does not allow the prefabricated building to be connected to a ground anchor via the floor or foundation. Additionally, the circular hole 2 is used only to accept a steel reinforcing bar and is not designed to be secured to a horizontal support member.

Another approach is taught by Lopes, in U.S. Pat. No. 4,294,053, wherein "An improved anchor is provided for use with a mobile home having an underframe with an I-beam and wherein the mobile home is mounted above a base. The anchor comprises a pair of spaced clamping elements, each clamping element having an upper flange engaging portion for engaging the I-beam and a lower down-wardly depending portion. One end of a chain is positioned between the downwardly depending portions of the clamping elements while a clevis is inserted through registering apertures in the downwardly depending portions and also through a link of the chain to thereby secure said end of the chain to the clamping elements. The other end of the chain is attached via a turnbuckle to the base." The disadvantage of the approach is that an I-beam must be present to provide a connection site for this type of anchor to work. Furthermore, the location of the I-beams are not always positioned at the optimum location where the connections will have maximum leverage.

Still another approach is taught in the art of Thornbrugh of U.S. Patent Number wherein "Various different types of anchors and an anchor system using these anchors for house trailers and the like are disclosed. One of the anchors disclosed is designed for use in a concrete slab and the others are designed to meet specific soil conditions. Thus, of the various different anchors disclosed, the one chosen for a given anchor system depends upon either the soil conditions where the trailer is located or the existence of a concrete trailer pad. In addition, the anchors are designed so that they can be driven in place by means of power tools. The anchor system comprises a plurality of anchors and a chain and turnbuckle arrangement associated with each anchor. Brackets are attached to the trailer frame at various different positions along the frame. The anchors are driven into the ground or concrete as the case may be along the trailer and a separate chain and turn buckle arrangement is connected between each anchor and frame bracket. The turnbuckle are then adjusted to remove any lack in the chain." One disadvantage of this approach is that when the house trailers are fully assembled, there may not be enough locations to secure the brackets to adequately secure the house.

SUMMARY OF THE INVENTION

Accordingly, it is the primary object of this invention to provide a unique tie connector to secure a prefabricated, modular type building securely to the ground. The tie connector being affixed to the modular building at one end with the other end being affixed to a hurricane type strap. The hurricane strap is then affixed to the ground via a hurricane type ground anchor.

Another object of this invention is to have the tie connector installed during construction of the modular building. This will assure and facilitate proper installation when the modular building is to be secured to the ground.

Still another object of this invention is to provide a elongated slot, positioned on the tie connector, that will extend beneath a horizontal support member. This will allow the user to have easy access when a hurricane type strap is to be installed through the elongated slot.

A further object of this invention is to provide an elongated slot with rounded edges that will not cut into a hurricane strap during stress. The rounded edges having a radius of sufficient size thereby omitting a knife or cutting effect on the strap when under stress.

Another object of this invention is to provide a horizontal flap that will secure onto a horizontal support member of the modular building. These horizontal flaps of the tie connectors will be installed around the perimeter of the modular building to prevent any type of lifting movement.

Still a further object of this invention is to provide a vertical flap that will secure onto a vertical support member of the modular building. The vertical flap will have at least one bolt to secure onto a vertical support member of the modular building giving additional support and stability.

Still another object of this invention is to have the thickness or gauge of the tie connector varied to accommodate various stress requirements.

Another object of this invention is to provide an elongated slot built into the side surface of tie connector that will provide an attachment site for a hurricane strap. The hurricane strap will be inserted through the slot around and affixed to a provided buckle.

In carrying out this invention in the illustrative embodiment thereof, a plurality of tie connectors are installed during construction of modular buildings whereby the horizontal flaps of the tie connectors are affixed to horizontal support members. The tie connectors are installed around the perimeter of the modular building to provide maximum stability. The other end of the tie connector contain built-in elongated slots that are exposed beneath the modular building. After the modular building is set in place, hurricane straps are inserted through the elongated slots and coupled together with buckles. The buckles are then secured to the ground via hurricane type ground anchors. Conveniently, the user may connect one end of a Hurricane strap to the elongated slot from the tie connector and the other end to a hurricane buckle. The hurricane buckle is then connected to a hurricane ground anchor.

BRIEF DESCRIPTION OF THE DRAWINGS

This invention, together with other objects, features, aspects and advantages thereof, will be more clearly understood from the following description, considered in conjunction with the accompanying drawings.

Six sheets drawings are furnished, sheet one contains FIG. 1 sheet two contains FIG. 2 sheet three contains FIG. 3 sheet four contains FIG. 4 sheet five contains FIG. 5 and sheet six contains FIG. 6.

FIG. 5 is an orthographic view of the tie connector clearly showing the elongated slot where the hurricane strap is to be affixed. The upper part showing a opening to allow a bolt to fit through.

DESCRIPTION OF THE PREFERRED EMBODIMENTS

Figure 1:
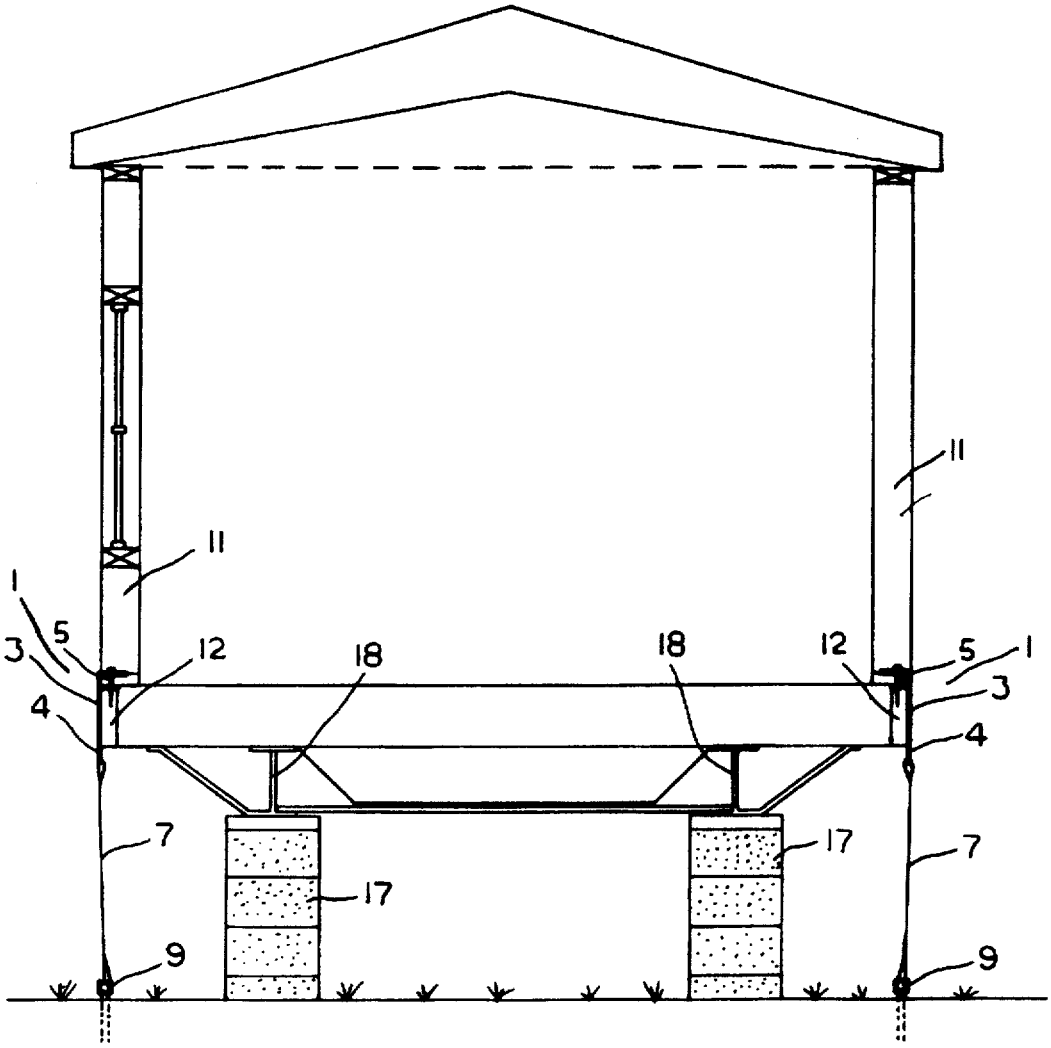
FIG. 1 is a side cut-away view of a modular building showing where the tie connectors are to be installed.

Referring now to FIG. 1, a tie connector referred to generally by the reference numeral 1 is made of a elongated slit 4 at one end. The elongated slit 4 providing an attachment site for a hurricane strap 7 to connect to which in turn is affixed to hurricane ground anchor 9. the top of the tie connector 1 having a bolt 5 inserted through and affixed to a horizontal support member 12. The horizontal support member 12 being abutted against the side surface 3 and supporting a vertical support member 11. All of the horizontal support members 12 are supported by I-beams 18 which in turn are supported by a plurality of blocks 17.

Figure 2:
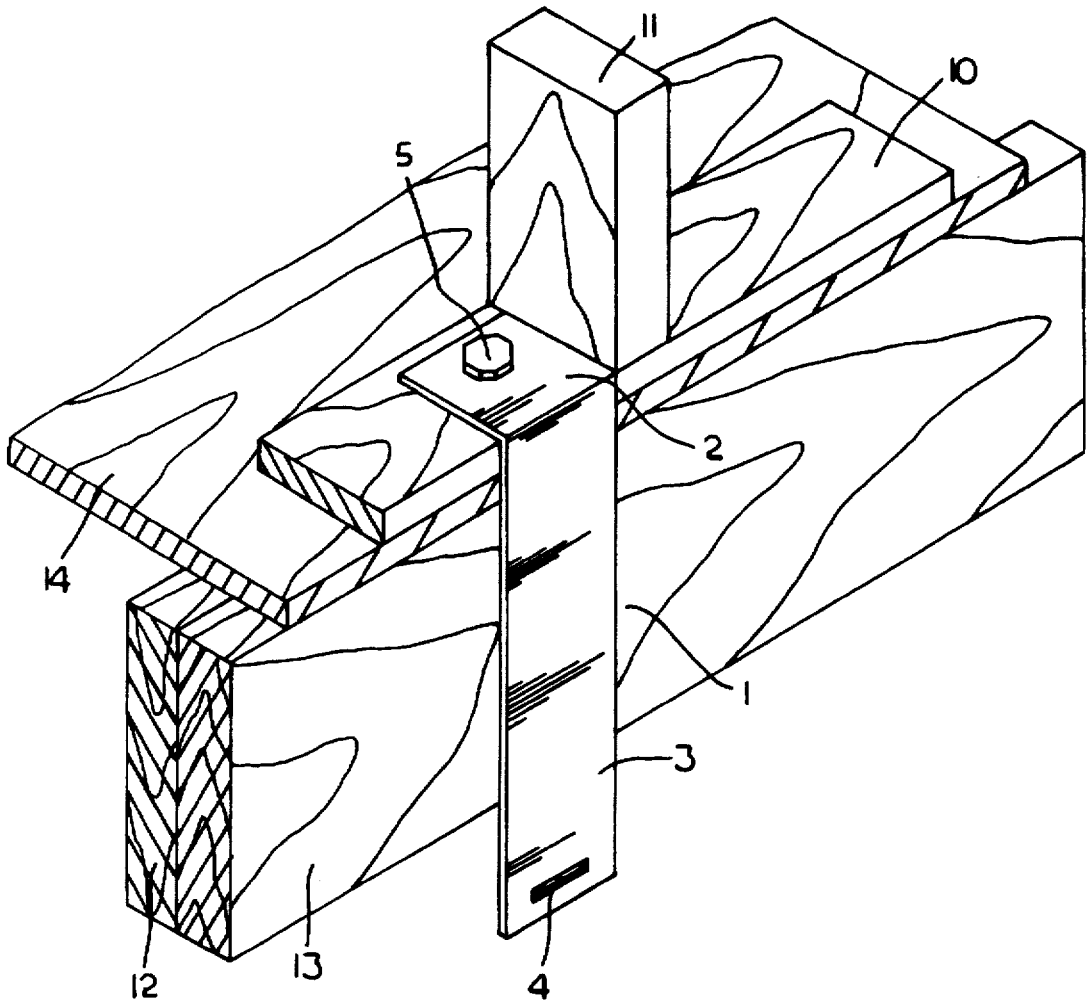
FIG. 2 is an orthographic view of the tie connector installed on a horizontal support member showing the elongated slot.

Referring now to FIG. 2, we see a tie connector 1 having an elongated slot 4 at one end. A side surface 3 having an upper body section 3*a* being abutted against a horizontal support member 13 and a lower body section 3*b* having the elongated slot 4 extending downward beneath the supports 13. The top of the horizontal flap 2 having a bolt 5 inserted through and affixed to a horizontal support member 12. The horizontal support member 12 supporting a vertical support member 11. The top portion of the horizontal members 12 and 13 supporting both platform 14 and board 10.

Figure 3:
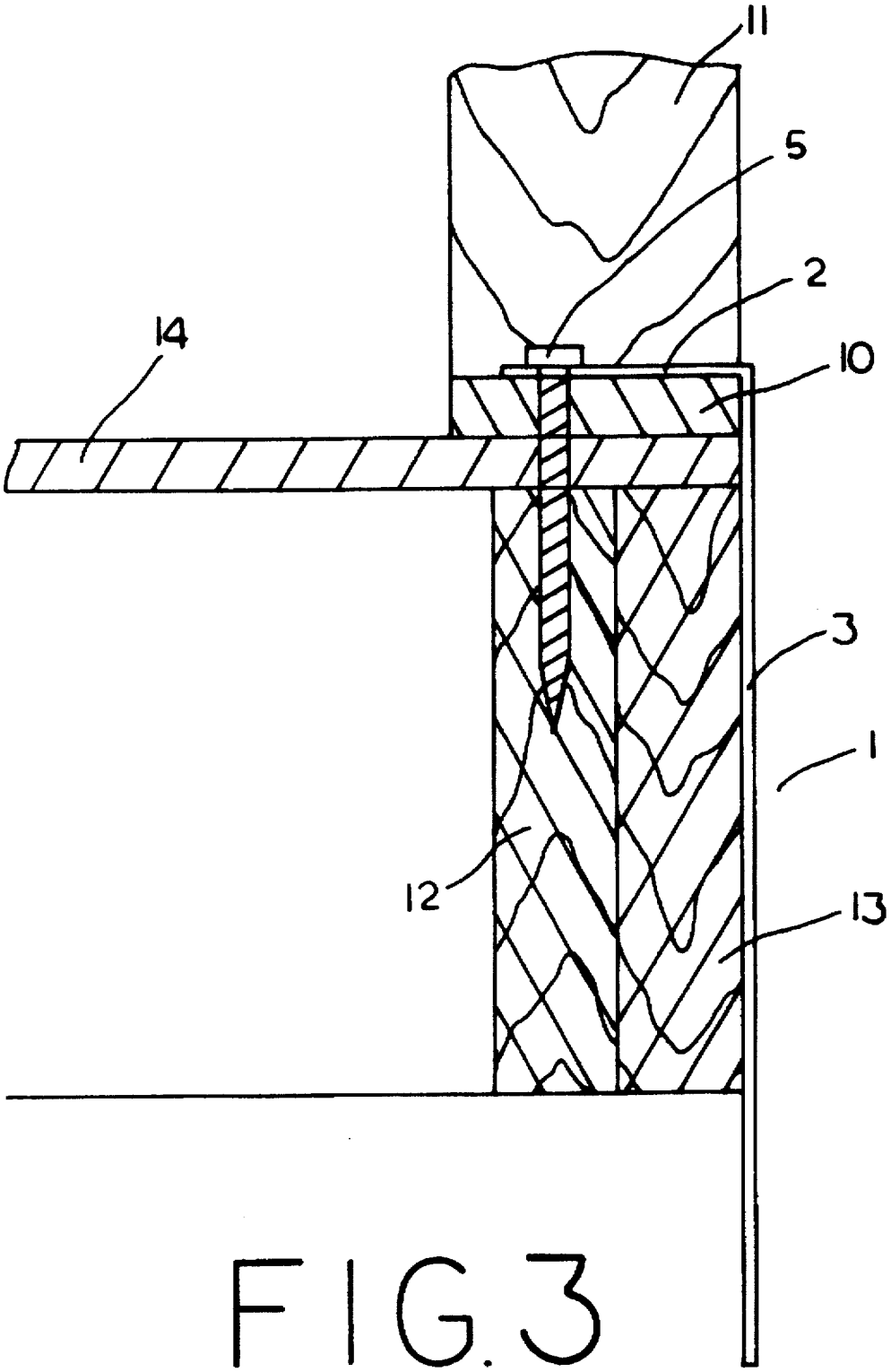
FIG. 3 is a side cut-away view of the tie connector showing a bolt penetrating through a horizontal support member thereby securing the tie connector to the floor of the modular building.

Referring now to FIG. 3, we see a side view of a tie connector 1 having a side surface with the upper body section 3*a* 3 being abutted against a horizontal support member 13. A portion or the lower body section 3*b* of the side surface 3 extending downward beneath the horizontal support member 13. The top horizontal flap 2 or mounting plate of the tie connector 1 having a bolt 5 inserted through and affixed to a horizontal support member 12. The horizontal support member 12 being abutted against horizontal support member 13 and supporting a platform 14 and board 10. Both platform 14 and board 10 supporting vertical support member 11.

Figure 4:
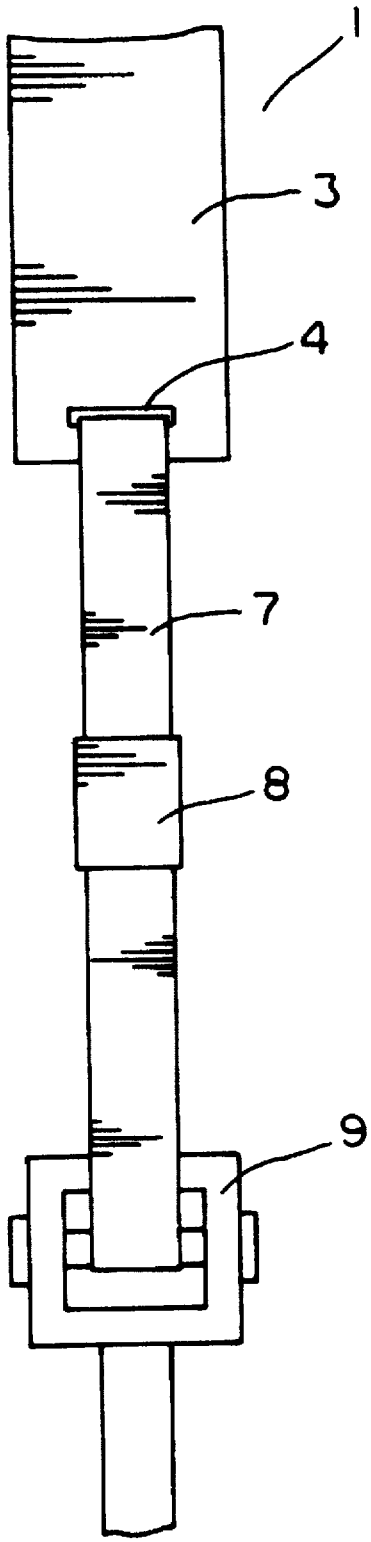
FIG. 4 is front view of the bottom portion of the tie connector affixed to a hurricane strap which in turn is affixed to a hurricane buckle or seal. The hurricane buckle in turn is affixed to a hurricane ground anchor.

Referring now to FIG. 4, we see a front view of the bottom portion of the tie connector 1 having a side surface 3 with an elongated slot 4 at one end. A hurricane strap 7 is inserted through the tie connector 1 via the elongated slot 4 and secured to the other end by a hurricane buckle 8. The opposite portion of the hurricane strap 7 is affixed to a hurricane ground anchor 9 that is secured to the ground.

Figure 5:
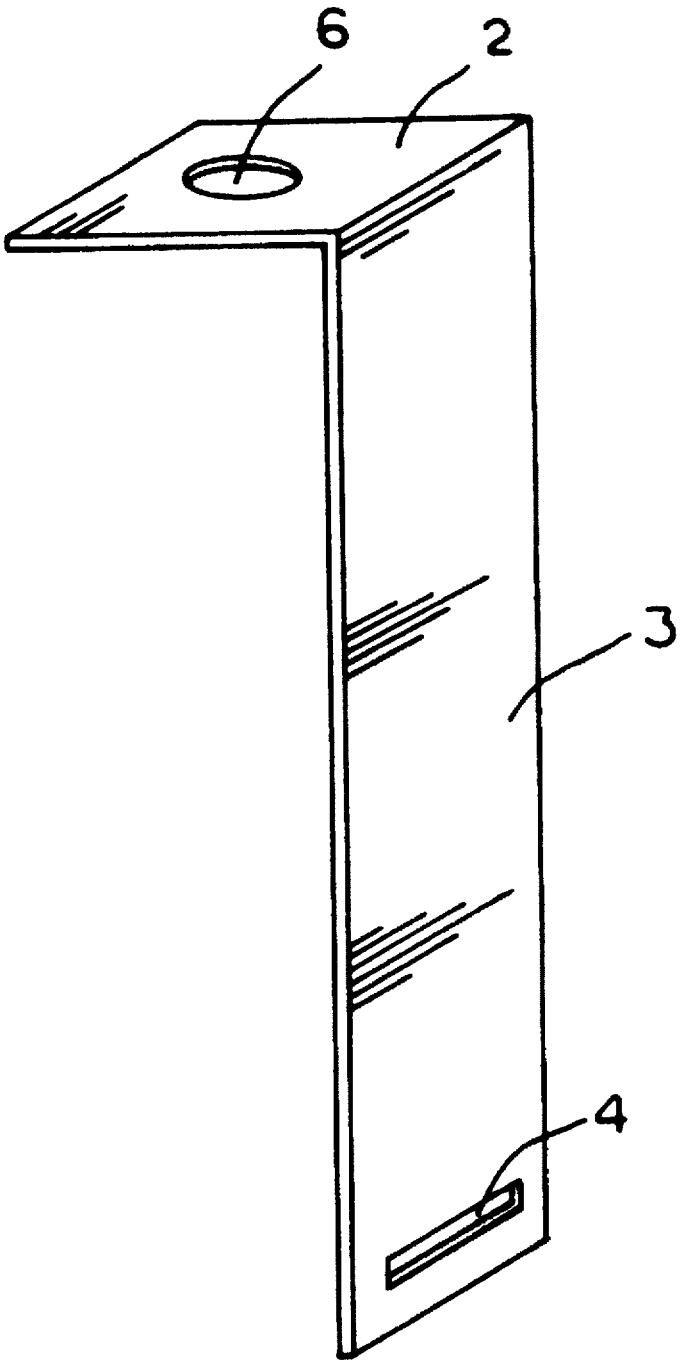

Referring now to FIG. 5, we see an orthographic view of the tie connector 1 having a side surface 3 with an elongated slot 4 at the bottom end. Or lower body section 3*b* the tie connector 1 having a top horizontal flap 2 or mounting plate with an opening 6 to allow at least one bolt to be inserted to provide an affixing means.

Figure 6:
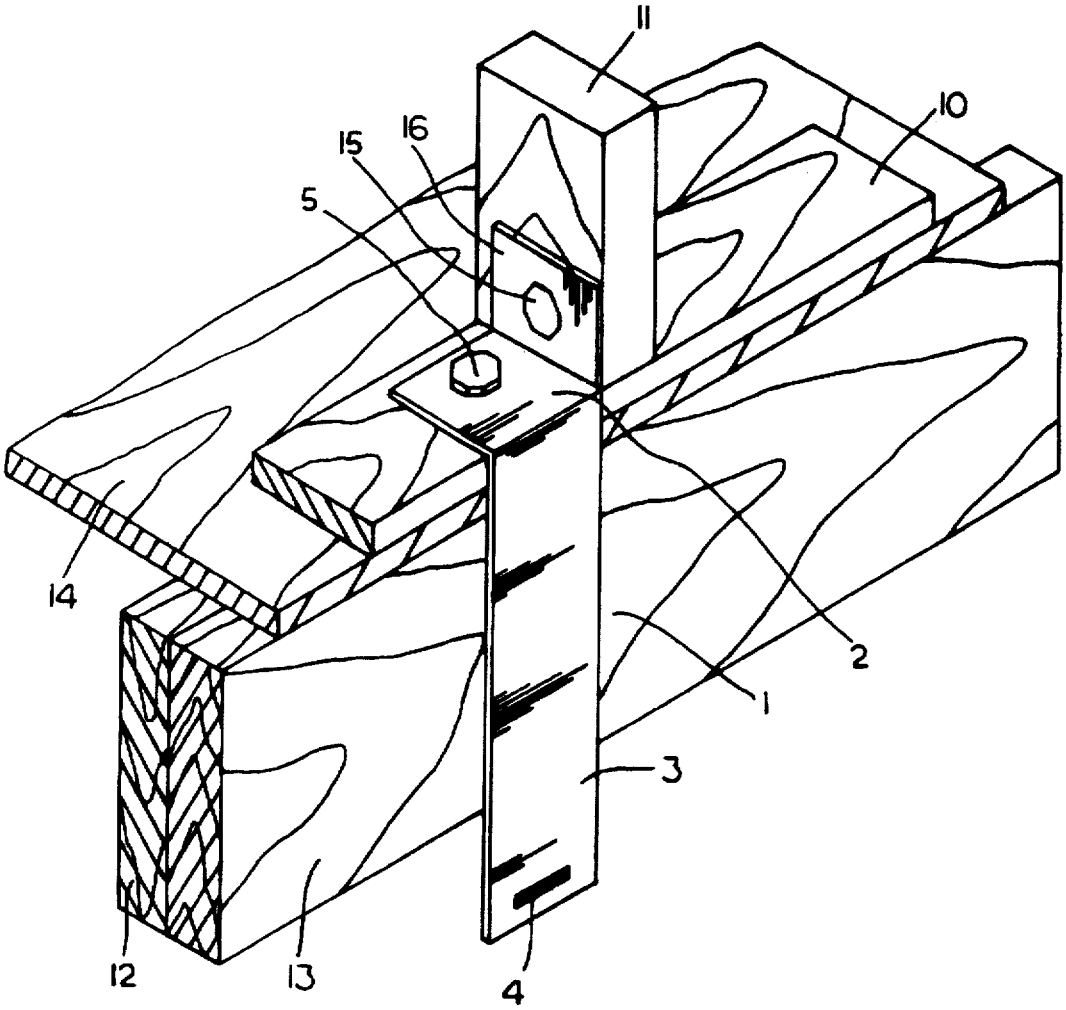
FIG. 6 is an orthographic view of a different version of the tie connector showing an additional vertical flap secured onto a vertical support member for additional support.

Referring to FIG. 6, we see an alternate version of the tie connector 1 having an additional vertical flap 16 secured onto a vertical support member II via a bolt 15. Similarly, an elongated slit 4 is located at one end of a side surface 3 of the tie connector 1. The side surface 3 being abutted against a horizontal support member 13 and having the elongated slit 4 extending downward beneath the support 13. The top horizontal flap 2 of the tie connector 1 having a bolt 5 inserted through and affixed to a horizontal support member 12. The horizontal support member 12 being abutted against the side of horizontal support 13 and supporting a vertical support member 11. The top portion of the horizontal members 13 supporting both platform 14 and board 10.

Accordingly, a very unique apparatus is provided for joining modular type buildings to a hurricane type ground anchor via a tie connector and hurricane type strap.

Since minor changes and modifications varied to fit particular operating requirements and environments will be understood by those skilled in the art, the invention is not considered limited to the specific examples chosen for purposes of illustration, and includes all changes and modifications which do not constitute a departure from the true spirit and scope of this invention as claimed in the following claims and reasonable equivalents to the claimed elements.

What is claimed is:

1. A tie connector joining a factory made building to a ground anchor, the factory made building having a support member said tie connector affixed to the support member, and a hurricane strap connected to said tie connector and ground anchor, the tie connector comprising:

(a) an upper body section extending in a substantially vertical plane; and, (b) a mounting plate attached to the upper body section, perpendicular thereto and coextensive with a surface of said support member of a factory made building; and, (c) a lower body section connected to the upper body section, distal the mounting plate, having a slot receiving the hurricane strap; and, (d) means for securing the mounting plate against said coextensive surface of the support member.

2. A tie connector as set forth in claim 1 wherein said slot has rounded edges to eliminate any cutting affect of said strap during high stress conditions.

3. A tie connector as set forth in claim 1 wherein length of said slot being long enough to accept a given width of said hurricane strap.

4. A tie connector as set forth in claim 1 wherein a width of said slot being wide enough to accept a given thickness of said hurricane strap.

5. A tie connector joining a factory made building to a ground anchor, the factory made building having a support member having a horizontally and vertically disposed surfaces thereon, and a hurricane strap connecting the tie connector and ground anchor, the tie connector comprising:

(a) an upper body section extending in a substantially vertical plane;

(b) a first mounting plate attached to the upper body section of the tie connector, perpendicular thereto and extending over said horizontally disposed surface of said support member of a factory made building;

(c) a second mounting plate attached to said first mounting plate, and perpendicular thereto extending upward, against said vertically disposed surface of said support member;

(d) means for securing the first mounting plate to the horizontally disposed surface of said support member and said second mounting plate to said vertically disposed surface of said member; and, (e) a lower body section affixed to the bottom of the upper body section and having a slot receiving the hurricane strap.

6. A tie connector as set forth in claim 5 wherein a length of said slot being long enough to accept a given width of said hurricane strap.

7. A tie connector as set forth in claim 5 wherein a width of said slot being wide enough to accept a given. thickness of said hurricane strap.

* * * * *